US007727033B2

(12) United States Patent
Tsuji

(10) Patent No.: US 7,727,033 B2
(45) Date of Patent: Jun. 1, 2010

(54) SURFACE MOUNT ELECTRICAL CONNECTOR

(75) Inventor: Junya Tsuji, Tokyo (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 293 days.

(21) Appl. No.: 11/813,996

(22) PCT Filed: Dec. 12, 2005

(86) PCT No.: PCT/JP2005/023187

§ 371 (c)(1),
(2), (4) Date: Jul. 14, 2007

(87) PCT Pub. No.: WO2006/077707

PCT Pub. Date: Jul. 27, 2006

(65) Prior Publication Data

US 2009/0035961 A1 Feb. 5, 2009

(30) Foreign Application Priority Data

Jan. 18, 2005 (JP) ..... 2005-009838

(51) Int. Cl.
*H01R 4/48* (2006.01)

(52) U.S. Cl. ..... 439/862; 439/83; 439/876

(58) Field of Classification Search ..... 439/83, 439/84, 862, 869, 870, 874, 875, 876
See application file for complete search history.

(56) References Cited

U.S. PATENT DOCUMENTS

| | | | | |
|---|---|---|---|---|
| 5,281,152 | A * | 1/1994 | Takahashi et al. | 439/79 |
| 5,453,028 | A * | 9/1995 | Grambley et al. | 439/441 |
| 5,516,297 | A * | 5/1996 | Atoh et al. | 439/79 |
| 6,056,558 | A * | 5/2000 | Lin et al. | 439/83 |
| 6,409,546 | B1 | 6/2002 | Ito et al. | |
| 6,755,667 | B2 * | 6/2004 | Lin | 439/83 |
| 6,926,541 | B2 | 8/2005 | Takeuchi et al. | |
| 6,984,130 | B2 * | 1/2006 | Richter et al. | 439/66 |
| 6,988,916 | B2 * | 1/2006 | Taguchi | 439/862 |
| 6,991,472 | B2 * | 1/2006 | Du et al. | 439/66 |
| 7,083,446 | B2 | 8/2006 | Tanaka et al. | |
| 2002/0115320 | A1 | 8/2002 | Nishiio et al. | |
| 2002/0127899 | A1 * | 9/2002 | Ikeda et al. | 439/159 |
| 2009/0035961 | A1 * | 2/2009 | Tsuji | 439/78 |

FOREIGN PATENT DOCUMENTS

| | | |
|---|---|---|
| JP | 6302345 | 10/1994 |
| JP | 2001143825 | 5/2001 |
| JP | 2003168503 | 6/2003 |
| JP | 2003317833 | 11/2003 |
| JP | 2004207168 A * | 7/2004 |

* cited by examiner

*Primary Examiner*—James Harvey
(74) *Attorney, Agent, or Firm*—Barley Snyder LLC

(57) ABSTRACT

A surface mount electrical connector for mounting to a substrate comprising a housing and a contact carried by the housing, the contact comprising a retention section held by the housing and a tine configured for mounting to a surface of the substrate wherein the tine extends from the retention section and wherein the tine lies inside an outer contour line of the housing is disclosed. A method of connecting a surface mount electrical connector to a substrate comprising the steps of providing a housing carrying a contact, the contact having a tine within a projected footprint of the housing on the substrate, attaching the housing to the substrate, inserting a jig into an opening of the housing, and bending the tine toward the substrate is disclosed.

20 Claims, 4 Drawing Sheets

SURFACE MOUNT ELECTRICAL CONNECTOR

CROSS-REFERENCE TO RELATED APPLICATION DATA

This application claims the benefit of the earlier filed parent international application number PCT/JP2005/023187 having an international filing date of Dec. 12, 2005 that claims the benefit of JP2005-9838 having a filing date of Jan. 18, 2005.

FIELD OF THE INVENTION

The present invention relates to an electrical connector, and more specifically, to a surface mount electrical connector in which tines of electrical contacts held by the electrical connector are surface mounted on a circuit board.

BACKGROUND

Various types of surface mount electrical connectors are known. As an example, a memory card connector device that comprises a contact block, having contacts held therein, provided in the rear portion of the connector body, and a slider that moves within the connector body in the forward-backward directions according to an insertion/removal operation of a card is known as described, for example, in Japanese Unexamined Patent Publication No. 2004-207168 (FIGS. 5, 6). The contact block used in the connector device comprises a heart cam groove, which collaborates with a lock metal that moves therein to form what is known as the push-push connector. In the connector device, the tines of the contacts are protruding externally from the connector body so as to be surface mounted on a circuit board.

Recently, electronic devices, such as digital cameras, personal computers, and the like, have been made compact, and along with this, it is customary that electrical/electronic components incorporated in electronic devices are densely surface mounted on a circuit board. In order to densely surface mount electrical/electronic components, there has been a demand that the electrical/electronic components be made small so as to occupy small areas on the circuit board. This also allows the circuit board itself to be made compact.

In such a surface mount electrical connector, it is customary that the tines of contacts protrude externally from the connector and are soldered to the circuit board, as in the connector device disclosed in Japanese Unexamined Patent Publication No. 2004-207168. Tines are disposed so as to have the same gap with respect to the circuit board. Generally, the gap is not greater than 0.1 mm. The gap between each tine and circuit board, however, may be increased due to warpage of a housing to which the contacts are attached. For example, too large of a gap causes improper soldering, and thereby a defective product is produced. In order to avoid this, and in order to obtain coplanarity of the tines with respect to the circuit board, the gap between each tine and the circuit board is detected, and if the gap is greater than a predetermined value, the tine is pressed toward the circuit board using a jig so that the gap falls within a predetermined range. Therefore, it is convenient for detecting the coplanarity and verification of proper soldering, if the tines are protruding externally from the connector holding the contacts. Further, the protrusion of the tines may facilitate correction of the coplanarity. The protrusion of the tines, however, poses a problem that the area of the circuit board occupied by the connector is increased.

The present invention has been developed in view of the circumstances described above, and it is an object of the present invention to provide a compact surface mount electrical connector which requires a small area on the circuit board, yet allows tine coplanarity adjustment.

SUMMARY

The present invention relates to a surface mount electrical connector for mounting to a substrate comprising a housing and a contact carried by the housing, the contact comprising a retention section held by the housing and a tine configured for mounting to a surface of the substrate wherein the tine extends from the retention section and wherein the tine lies inside an outer contour line of the housing. The present invention also relates to a method of connecting a surface mount electrical connector to a substrate comprising the steps of providing a housing carrying a contact, the contact having a tine within a projected footprint of the housing on the substrate, attaching the housing to the substrate, inserting a jig into an opening of the housing, and bending the tine toward the substrate.

DETAILED DESCRIPTION OF THE EMBODIMENT(S)

Figure 1A:
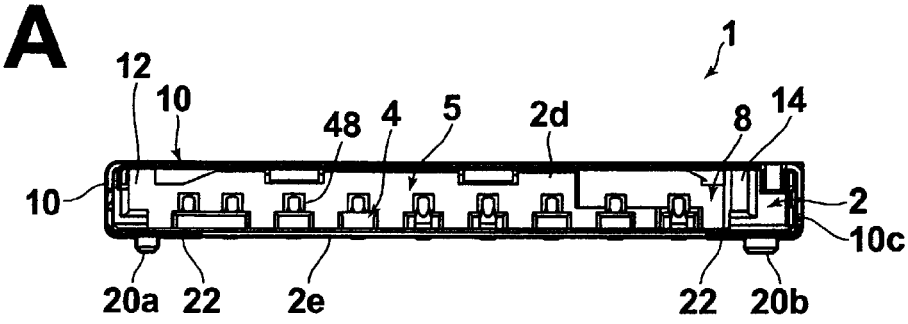
FIG. 1A is a front view of a surface mount electrical connector according to an embodiment of the present invention, illustrating an overview thereof.

Hereinafter, an exemplary embodiment of a surface mount electrical connector (hereinafter, simply referred to as "connector"), of the present invention will be described with reference to the accompanying drawings. First, an overview of the connector 1 will be described with reference to FIGS. 1A to 2C. The phrase "aligned electrical contacts" as used herein means, for example, the electrical contacts disposed slightly in a zigzag pattern but basically maintaining the directionality, as well as those accurately disposed in a straight line. In the following description, the referent of "front" means a side from where a card (not shown) is inserted, and "rear" means a side opposite to the front in the plan view of the connector 1 in FIG. 1B. The connector 1 is a card connector and comprises a housing 2, contacts 4 held by the housing 2, an ejection mechanism 8, and a metal shell 10 attached to the housing and substantially covers these components. The ejection mechanism 8 is a mechanism that moves along card insertion-removal directions 6 (FIGS. 1B, 2A) according to insertion/removal of a card.

Figure 1B:
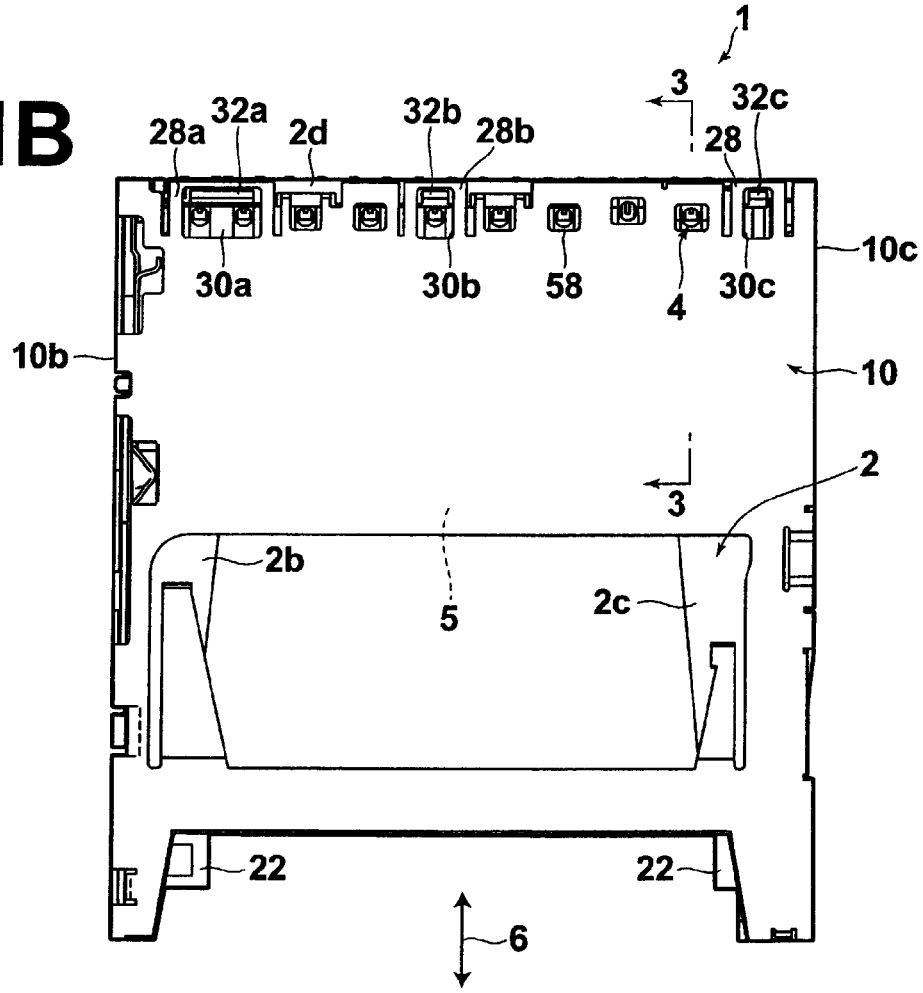
FIG. 1B is a plan view of the surface mount electrical connector shown in FIG. 1A, illustrating an overview thereof.
Figure 1C:
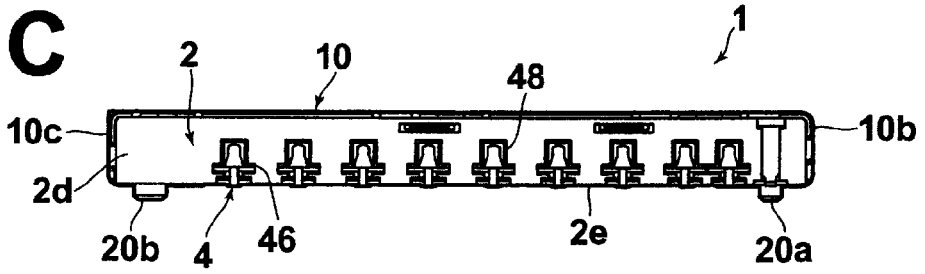
FIG. 1C is a rear view of the surface mount electrical connector shown in FIG. 1A, illustrating an overview thereof.
Figure 2A:
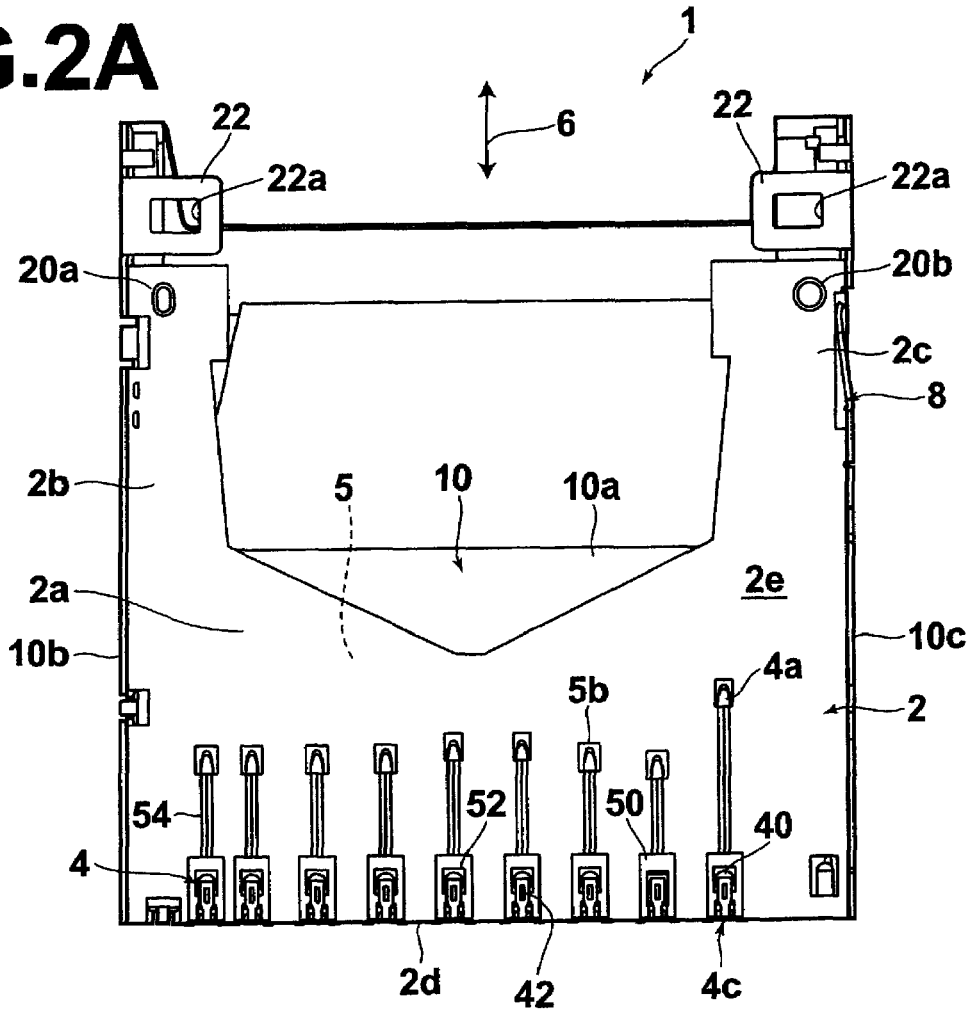
FIG. 2A is a bottom view of the surface mount electrical connector shown in FIG. 1A.

The housing 2 comprises a body 2*a* located in the rear portion thereof, and first and second card guides 2*b*, 2*c* extending from the body 2*a* to the front side. The body 2*a* is open on the upper side and comprises a body rear wall 2*d* at the rear end. The first and second card guides 2*b*, 2*c* comprise first and second card guide paths 12, 14, respectively, on the inner side thereof (FIG. 1A). The card guide paths 12, 14 extend to the inside of the body 2*a*. The first card guide 2*b* comprises first and second detection contacts 16, 18 (FIG. 2B) for detecting insertion of a card or readiness of the card for write operation, but these are not the subject matter of the present invention and will not be described in detail here. The housing bottom surface 2*e* of the housing 2 is substantially flat, but comprises first and second positioning bosses 20*a* and 20*b* at the front ends of the first and second card guides 2*b*, 2*c*, respectively.

The second card guide 2*c* comprises an ejection mechanism 8 which is formed such that when a card is inserted into the connector 1 from the front side and pushed into the inside of the connector 1, the card is held at the position inside the connector 1, and when the card is pushed again, it is ejected from the connector 1. The ejection mechanism 8 comprises a slider (not shown) which operates by an insertion/ejection operation. The slider is constantly urged by a spring toward the front side of the housing. The ejection mechanism 8 comprises a heart-shaped cam groove (not shown) and a cam follower (not shown) that moves within the cam groove. This structure is well known in the art, and in addition, it is not the subject matter of the present invention, so that it will not be described in detail here.

Figure 3:
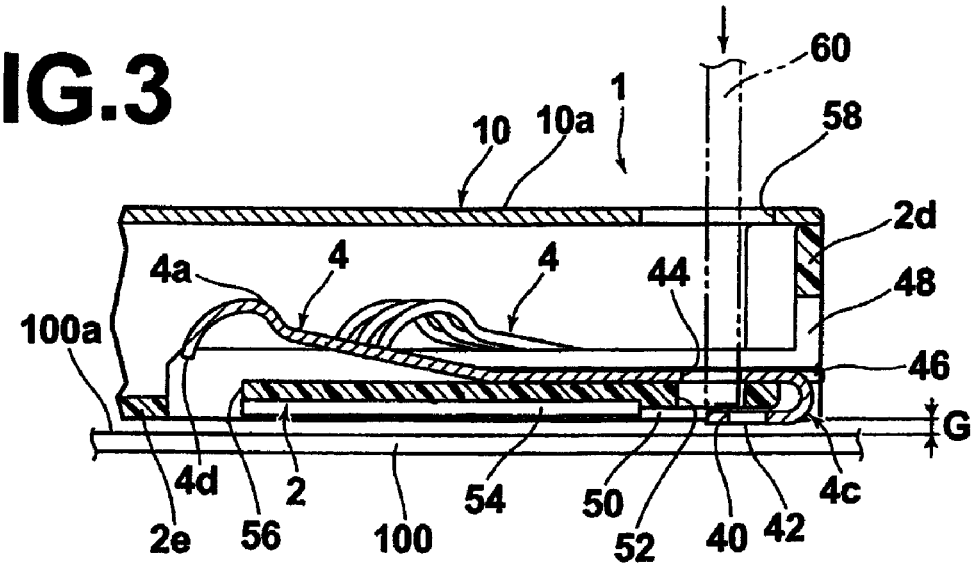
FIG. 3 is a partially enlarged cross-sectional view taken along the line 3-3 in FIG. 1B.
Figure 4:
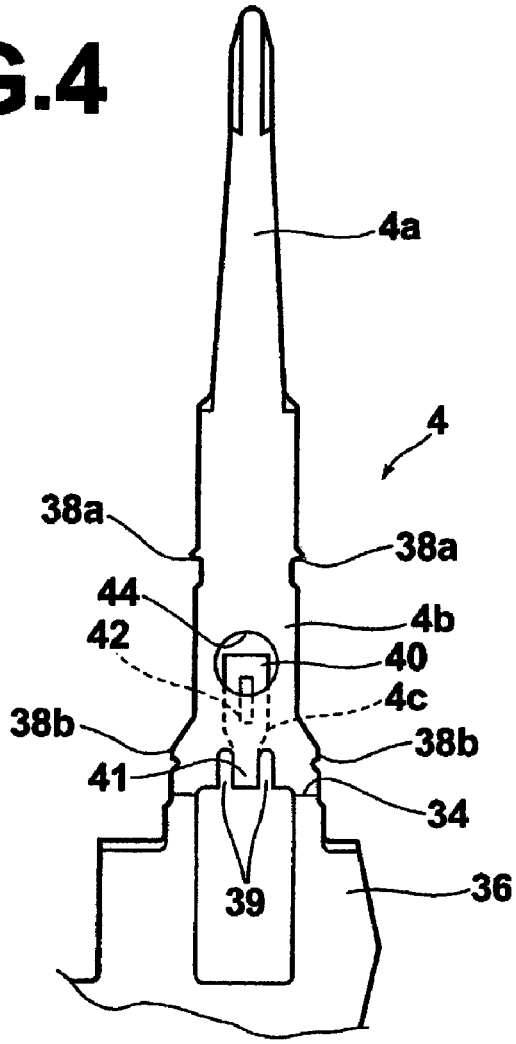
FIG. 4 is an enlarged plan view of an electrical contact with a carrier strip.
Figure 5A:
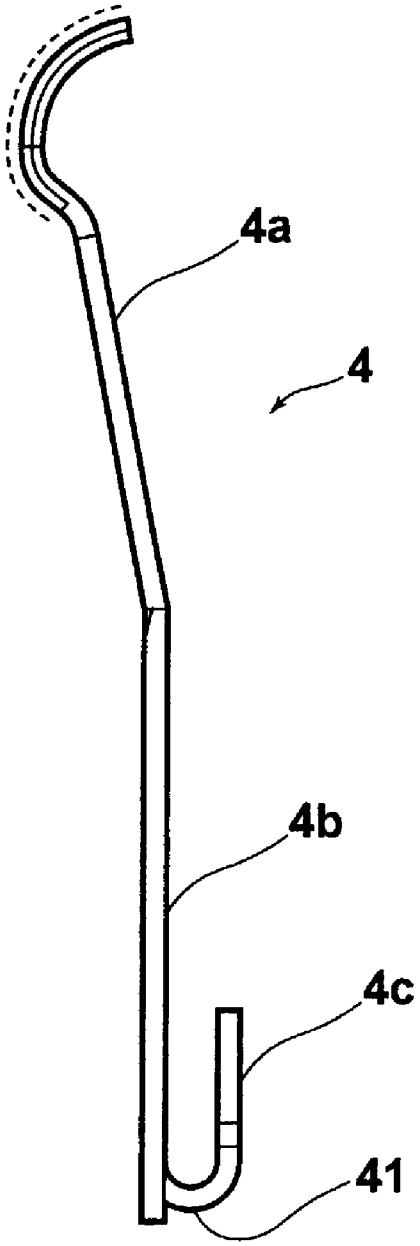
FIG. 5A is a side view of the electrical contact separated from the carrier strip.
Figure 5B:
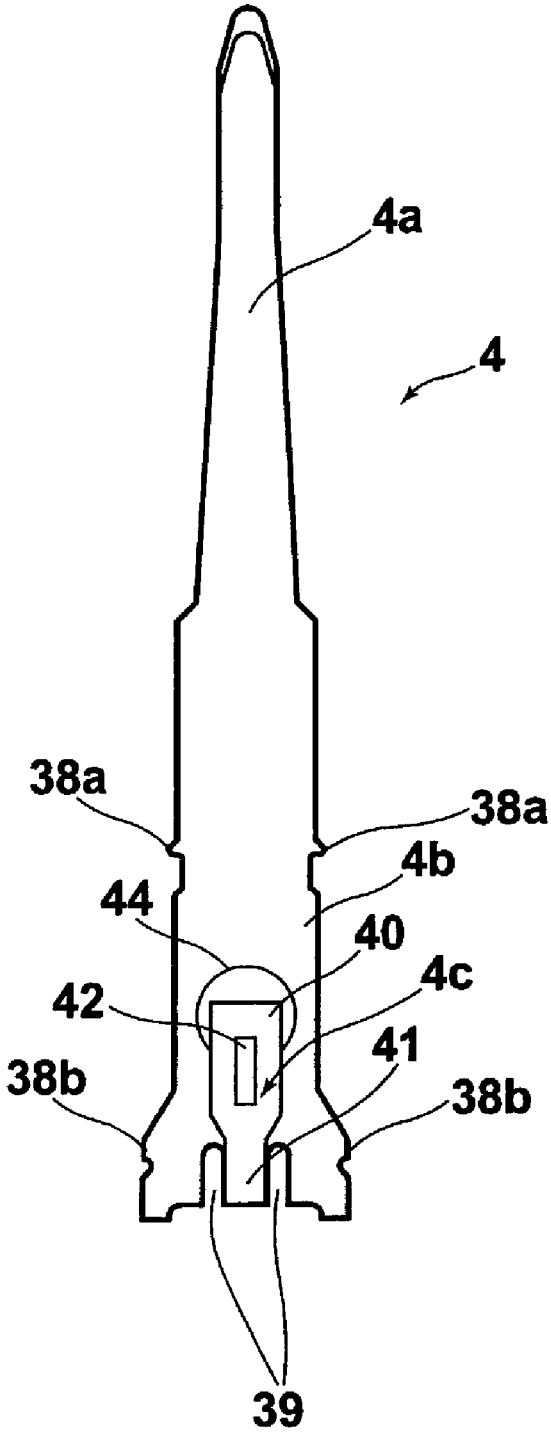
FIG. 5B is a bottom view of the electrical contact separated from the carrier strip.

Next, the description will be directed to the shell 10. It is formed of a single metal plate through punching and folding, and comprises a principal surface 10*a* (FIG. 1B) that covers the upper side of the housing 2, and first and second shell side walls 10*b*, 10*c* folded over the outer sides of the first and second card guides 2*b*, 2*c*, respectively. Protruding rectangular attachment pieces 22 (FIG. 2A) are provided at places adjacent to the front end of the first and second card guides 2*b*, 2*c* and are folded to the under surface of the first and second card guides 2*b*, 2*c*. This prevents the shell 10 from moving upward from the housing 2. Each attachment piece 22 comprises a rectangular opening 22*a* in the center and is soldered to a circuit board (substrate) 100 (FIG. 3). The principal surface 10*a* of the shell 10 that is attached to the housing 2, and housing 2 define a card receiving section 5.

Figure 2B:
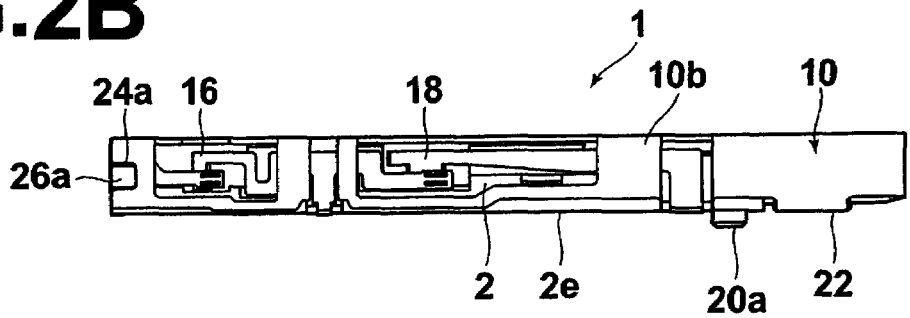
FIG. 2B is a left side view of the surface mount electrical connector shown in FIG. 1A.
Figure 2C:
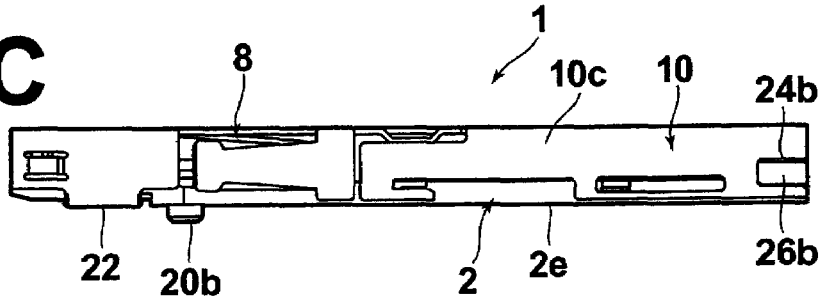
FIG. 2C is a right side view of the surface mount electrical connector shown in FIG. 1A.

As illustrated in FIGS. 2B, 2C, first and second notches 24*a*, 24*b* open to the rear side are provided on the first and second shell side walls 10*b*, 10*c*, respectively. In the mean time, first and second protrusions 26*a*, 26*b*, corresponding to each of the first and second notches 24*a*, 24*b*, respectively, are provided on the side surfaces of the first and second card guides 2*b*, 2*c*, respectively. Engagement of the first and second notches 24*a*, 24*b* with the first and second protrusions 26*a*, 26*b* prevents the shell 10 from moving upward and backward of the housing 2. The shell 10 comprises, at the rear end portion of the principal surface 10*a*, first, second, and third lock tongues 28*a*, 28*b*, 28*c*, respectively, which are free at the rear end. The first, second, and third lock tongues 28*a*, 28*b*, 28*c* each comprise a rectangular lock hole, specifically, first, second, and third lock holes 30*a*, 30*b*, 30*c*, respectively. Further, first, second, and third projecting bars 32*a*, 32*b*, 32*c*, corresponding to the lock holes 30*a*, 30*b*, 30*c*, respectively, are provided at the body rear wall 2*d* of the housing 2. The engagement of the first, second, and third lock holes 30*a*, 30*b*, 30*c* with the first, second, and third projecting bars 32*a*, 32*b*, 32*c*, respectively, prevents the shell 10 from moving the front side of the housing 2.

Next, the description will be directed to the contact 4 and attachment thereof to the housing 2 with reference also to FIGS. 3 to 5B. First, the contact 4 will be described with reference to FIGS. 4 to 5B. The contact 4 comprises a narrow width contact segment 4*a*, a wide width retention section 4*b*, and a tine 4*c* folded back in a U-shape from the retention section 4*b*. A contact notch 34, V-shaped in cross section and extending in the direction orthogonal to the axis line along the longitudinal direction of the contact 4, is formed at the rear end of the contact 4. The contact 4 is connected to the carrier strip 36 via the contact notch 34, and separated therefrom by the contact notch 34.

First and second lock protrusions 38*a*, 38*b*, spaced apart from each other, are formed at each side edge of the retention section 4*b*. When the contact 4 is inserted into a contact insertion groove 46, to be described later, of the housing 2, the first and second lock protrusions 38*a*, 38*b* engage with the contact insertion groove 46 and are fixed to the housing 2. The contact segment 4*a* is narrower in width than the retention section 4*b*, is biased from the retention section 4*b*, and has an arc-shaped tip. Two slots 39 open to the rear side, are formed at the rear end of the contact 4. A narrow width connection section 41 of the tine 4*c* extends in a U-shape between the slots 39, followed by a wide width soldering portion 40, which is parallel to the retention section 4*b*. The soldering portion 40 comprises a rectangular aperture 42 in the center. Further, a hole 44 is provided at a position of the retention section 4*b* right above the soldering portion 40. The hole 44 is a passage hole for a jig 60 (FIG. 3) for allowing access to the soldering portion 40 of the tine 4*c*. The area of the substrate 100 occupied by the surface mount electrical connector 1 is thereby reduced without protruding the tine 4*c* outside an outer contour of the housing 2.

Next, the description will be directed to the state in which the contact 4 is attached to the housing 2 with reference to FIGS. 1A to 3 again. As illustrated in FIG. 3, the housing 2 comprises a contact insertion groove 46 extending forward along the bottom surface 2*e* from the rear wall 2*d*. The contact insertion groove 46 has a width which allows the retention section 4*b* of the contact 4 to be engaged therewith. Further, a contact insertion opening 48 is provided on the body rear wall 2*d* to allow the contact 4 to be inserted through the body rear wall 2*d*. The housing 2 comprises a rectangular depression 50 for accommodating the soldering portion 40 of the tine 4*c*, and a rectangular channel 52 vertically running through the housing 2 is provided at a position corresponding to the soldering portion 40 placed in the depression 50. The channel 52 of the housing is also connected with the hole 44 of the contact 4.

The housing bottom surface 2*e* of the housing 2 comprises a V-groove 54, V-shaped in cross-section and extending forward from the depression 50 along the card insertion-ejection directions. The V-groove 54 is provided for reducing thermal stress when the connector 4 is mounted, and formed to the tip of the contact segment 4*d* and an escape hole 56. The escape hole 56 runs upward through the housing 2 from the housing bottom surface 2*e*. The escape hole 56 is provided for the tip 4*d* of the contact segment 4 not to interfere with the housing 2 by bending toward the housing 2 when a card is inserted. The principal surface 10*a* of the shell 10 comprises a principal surface opening 58 formed aligned with the tine 4*c*, rectangular channel 52, and hole 44. When the contact 4 is attached to the housing 2, the tine 4*c* is located inside of the body rear wall 2*d*, as illustrated in FIG. 3. In other words, the tine 4*c* remains inside of the outer contour line or footprint of the housing 2 as projected onto the substrate 100 from above the housing 2. This is clearly illustrated in FIGS. 1B and 2A. This arrangement reduces the area of the substrate 100 occupied by the connector 1.

The description will now be directed to a method for correcting the coplanarity of the tines 4*c* of the contacts 4 structured in the manner as described above. A situation requiring correction of the position of the tine 4*c*, i.e., the height of the tine 4*c* from the substrate 100 means a case in which the housing 2 has deformed after forming, and a gap G which is greater than a predetermined value has developed, as illustrated in FIG. 3. The gap G may be detected, for example, by monitoring the connector 1 from the rear side by a camera, and determining variations in the gap G on the images generated by the camera. When a correction is performed, a stick-like jig 60 is inserted through the principal surface opening 58 of the shell 10 to the tine 4*c* through the hole 44 of the contact 4 and rectangular channel 52 of the housing 2, and the soldering portion 40 is pressed downward, i.e., toward the substrate 100 by the jig 60. This forces the soldering portion 40 to be displaced downward and the gap G is thereby situated within a predetermined range. Generally, the jig 60 has a bottom dead center set thereto to limit the traveling (moving distance) of the jig 60 to a predetermined value and the jig 60 is attached to a machine. The correction of the tine 4*c* is completed by a single pressing operation of the jig 60. Thereafter, the appropriately positioned soldering portion 40 is soldered to the substrate 100.

So far an exemplary embodiment of the present invention has been described, but the present invention is not limited to this, and it will be obvious to those skilled in the art that various changes and modifications may be made without departing from the scope of the invention. For example, in the present embodiment, the rectangular channel 52 of the housing 2 and hole 44 of the contact 4 for inserting the jig 60 have rectangular and circular shapes respectively, but they may alternatively have a polygonal shape, oval shape, or the like. Further, the rectangular channel 52 may have a notch shape, other than an opening with closed perimeter formed in the housing 2.

The invention claimed is:

1. A method of connecting a surface mount electrical connector to a substrate, comprising the steps of:

providing a housing carrying a contact, the contact having a tine within a projected footprint of the housing on the substrate, the tine having a soldering portion;

attaching the housing to the substrate;

inserting a jig into an opening of the housing; and bending the tine toward the substrate.

2. The method according to claim 1, further comprising the steps of:

after inserting the jig into the opening of the housing and before bending the tine toward the substrate, inserting the jig into a hole of a held section of the contact.

3. A surface mount electrical connector for mounting to a substrate, comprising:

a housing; and a contact carried by the housing, the contact comprising a held section held by the housing and a tine configured for mounting to a surface of the substrate, the tine folded back in a U-shape from the held section;

wherein the tine extends from the held section and wherein the tine lies inside an outer contour line of the housing.

4. The surface mount electrical connector of claim 3, wherein the outer contour line of the housing is defined by a footprint of the housing as projected onto the substrate from above the housing.

5. The surface mount electrical connector of claim 3, wherein the housing comprises an opening allowing access to the tine from outside the housing.

6. The surface mount electrical connector of claim 3, wherein the housing comprises an opening allowing access to the tine from above the housing.

7. The surface mount electrical connector of claim 3, wherein the contact has a hole in the held section aligned substantially above the tine.

8. The surface mount electrical connector of claim 3, wherein at least a portion of the tine lies substantially below the held section.

9. The surface mount electrical connector of claim 3, wherein at least a portion of the tine lies substantially below the held section.

10. The surface mount electrical connector of claim 3, wherein the housing comprises an opening substantially aligned with a hole of the held section and wherein the opening and the hole allow access to the tine from above the housing.

11. The surface mount electrical connector of claim 3, wherein the tine is configured for deformation toward the substrate.

12. The surface mount electrical connector of claim 3, wherein the tine comprises a rectangular aperture.

13. The surface mount electrical connector of claim 3, wherein the tine may be displaced to be substantially coplanar with the substrate.

14. The surface mount electrical connector of claim 3, wherein the tine comprises a soldering portion substantially below and parallel to the held portion and configured for being soldered to the substrate.

15. The surface mount electrical connector of claim 3, wherein the housing is configured to allow a jig to access the tine from above the housing.

16. The surface mount electrical connector of claim 3, wherein the housing is configured to allow a jig to access the tine from above the housing and bend the tine.

17. The surface mount electrical connector of claim 3, wherein the housing is configured to allow a jig to access the tine from above the housing and bend the tine toward the substrate.

18. The method according to claim 2, wherein the opening of the housing and the hole of the held section are substantially vertically aligned.

19. The method according to claim 1, further comprising the steps of:

soldering the tine to the substrate.

20. The method according to claim 1, further comprising the steps of:

bending the tine into a position substantially coplanar with the substrate.

* * * * *